US007204242B2

(12) United States Patent
Dziekan

(10) Patent No.: US 7,204,242 B2
(45) Date of Patent: Apr. 17, 2007

(54) TILLER, BOW AND TRIGGER MECHANISM FOR A CROSSBOW, AND A CROSSBOW

(76) Inventor: Marcin Dziekan, ul. Anielewicza 2 m. 28, Warszawa (PL) PL-00157

( * ) Notice: Subject to any disclaimer, the term of this patent is extended or adjusted under 35 U.S.C. 154(b) by 0 days.

(21) Appl. No.: 10/511,118

(22) PCT Filed: Apr. 12, 2002

(86) PCT No.: PCT/PL02/00030

§ 371 (c)(1),
(2), (4) Date: May 9, 2005

(87) PCT Pub. No.: WO03/087696

PCT Pub. Date: Oct. 23, 2003

(65) Prior Publication Data

US 2005/0279338 A1 Dec. 22, 2005

(51) Int. Cl.
*F41B 5/12* (2006.01)

(52) U.S. Cl. ..... 124/25

(58) Field of Classification Search ..... 124/25
See application file for complete search history.

(56) References Cited

U.S. PATENT DOCUMENTS 3,670,711 A 6/1972 Firestone
3,783,852 A * 1/1974 Shepherd ..... 124/22
4,594,994 A * 6/1986 Williams ..... 124/25
4,667,649 A 5/1987 Humphrey
4,711,228 A 12/1987 Gillespie
4,722,317 A 2/1988 Hartwig
4,942,861 A * 7/1990 Bozek ..... 124/25
4,976,250 A 12/1990 Jeffrey
5,215,069 A * 6/1993 Liu ..... 124/25
5,566,664 A 10/1996 Todd
5,685,286 A 11/1997 Summers

FOREIGN PATENT DOCUMENTS

GB 2158726 A 11/1985
WO WO 0043724 A 7/2000

* cited by examiner

*Primary Examiner*—John A. Ricci
(74) *Attorney, Agent, or Firm*—Townsend and Townsend and Crew LLP

(57) ABSTRACT

The invention relates to a tiller for a crossbow which has a cocking lever in the form of an upper arm (1) and a lower arm (2) pivotally connected with each other about an axis (X) in the front part of the tiller, whereas in the rear part of the tiller said upper arm (1) is connected with the upper end of a butt (5), and said lower arm (2) is connected with the lower end of the butt (5) in the folded state of the tiller by means of a snap fastener (6). Said tiller for a crossbow can be assembled with any appropriate bows and trigger mechanisms, but preferably it is used with a novel bow for a crossbow which is also disclosed.

11 Claims, 7 Drawing Sheets

TILLER, BOW AND TRIGGER MECHANISM FOR A CROSSBOW, AND A CROSSBOW

BACKGROUND OF THE INVENTION

The invention relates to a tiller and bow for a crossbow, and to a crossbow containing at least one of the aforementioned parts.

Crossbows having a bow (or prod) equipped with pulleys for a bowstring mounted on a tiller provided with a butt, trigger mechanism and aiming device, cocked by means of various cocking mechanisms, have been known for long time.

EP 0 132 017 B1 discloses a crossbow having a tiller which carries a prod and a bowstring arrestor, and having a release mechanism. Said prod is mounted for reciprocal movement relative to the tiller to facilitate cocking the bow. The crossbow is cocked with the use of a cocking mechanism comprising a crank lever which has one of its ends pivotally mounted to the stock by means of a stock pin and has its opposite end pivotally connected between the ends of a connecting lever by means of a crank pin. The "slider" of the cocking mechanism comprises a draw block to which one end of the connecting lever is mounted by means of a block pin. The connecting lever extends beyond the pivotal connection at the crank pin to provide a grip portion by which the cocking mechanism can be operated. To cock the bow the grip portion of the connecting lever is manipulated so that it is pushed away from the stock to pivot about the block pin. This action causes the draw block to slide along a forend tube towards an adjacent shoulder of the stock, whereby the grip and the bowstring are moved rearwardly together, as a unit. The crossbow stock is provided with a bowstring arrestor and release mechanism which automatically arrests the bowstring when it enters the mechanism. In this known cocking mechanism the crank lever is relatively short which limits possible maximum launch force.

EP 0 223 797 B1 discloses a crossbow equipped with an integrated drawing device which is supposed to facilitate fast cocking of the bowstring and placing said mechanism in a position where it does not hinder handling the crossbow and shooting. In this known solution the drawing device consists of two elements, a pusher and a draw lever rotatably mounted in a support of the crossbow to pivot about a horizontal axis transverse to the longitudinal axis of said support. Said axis is situated in the front part of a metal insert between a bow and a bowstring. In its lower part the draw lever is provided with a longitudinally extending recess into which the pusher of lesser thickness engages and is hinged at a point of rotation at a certain distance from said axis. The recess is so dimensioned that it can completely receive the pusher in the inserted position of the drawing device, except for its free end. This free end exhibits an indentation which in the drawing operation can engage a complementary or positively formed projection of trigger slide. With a movement of draw lever from the rest position toward the back end of the crossbow trigger slide is pressed back until it engages a holder of the trigger device. To be able to guarantee a flawless functioning, the distance of said axis from the point of rotation must be a little more than half the draw travel of the trigger slide or of the bowstring. To be able to house the drawing device inconspicuously and without hindering the shooting operation after the drawing operation, the metal insert and the adjacent front part of the support are provided with corresponding longitudinal groove sections which are so dimensioned that the drawing device when folded back into the extended (rest) position, together with the pusher in the recess of the draw lever, is completely received by the support. To avoid an automatic release of the drawing device from the rest position the draw lever is locked in the support by a latch provided on the front end of support, which engages in a notch on the front end of the draw lever. To eliminate any movement of the projectile guide in relation to the aiming device in this known crossbow extremely precise dimensional tolerances must be strictly observed during its manufacturing, which significantly increases production costs. Due to the structure of the cocking system the drawing force of this known crossbow is relatively small.

To the best knowledge of the applicant, there is no relevant prior art as far as the inventive bow and trigger mechanism are concerned.

SUMMARY OF THE INVENTION

The object of this invention is to provide modular parts of a crossbow which when combined with each other or when combined with suitable elements of various known crossbows, will overcome the aforementioned problems.

One aspect of the invention provides a tiller for a crossbow having a cocking lever in the form of an upper arm and a lower arm, said arms being pivotally connected with each other about an axis in the front part of the tiller, whereas in the rear part of the tiller said upper arm is connected with the upper end of a butt, and said lower arm is connected with the lower end of the butt in the folded state of the tiller by means of a snap fastener.

Another aspect of the invention provides a bow for a crossbow with pulleys for a bowstring, said bow having two limbs, the first limb having on its respective ends a front pulley and a back pulley, and a second limb having on its respective ends a front pulley and a back pulley, said limbs being pivotally connected by means of bolts with a central cross-bar carrying a pre-cocking mechanism to which a bowstring is fastened, wherein the first end of the bowstring is fastened to the pre-cocking mechanism on its side facing the second limb, from where the bowstring runs to the front pulley of the first limb and then, along the diagonal of the bow, to the back pulley of the second limb, and then to the back pulley of the first limb from where it runs, along the diagonal of the bow, to the front pulley of the second limb and then to the place at which its second end is fastened, said place being situated on the pre-cocking mechanism on its side facing the first limb.

In a preferred embodiment said bow limbs are provided at their both ends with recesses in which the pulleys are fixed and through which the bowstring runs.

Preferably the recesses are triangular with vertices directed towards the middle of the limbs.

In a preferred embodiment of the bow of the invention the pre-cocking mechanism is positioned centrally between the limbs, and has a body with a longitudinal slotted guide for a draw pin, said guide passing through said body in the direction of the limbs, and the ends of the bowstring are fastened on the sides of the body to the ends of the draw pin from where the bowstring runs to the front pulleys of the limbs, through a notch on the top of the body adjacent to a threaded hole for a draw screw connected with the draw pin.

Preferably the slotted guide and the threaded hole for the draw screw are situated diagonally in relation to the longitudinal axis of the body.

Another aspect of the invention provides a crossbow having a cocking mechanism and a bow with pulleys for a bowstring, said bow being mounted on a tiller including a projectile guide and provided with an aiming mechanism and a trigger mechanism, characterized by having the above defined tiller of the invention as its tiller and the above defined bow of the invention as its bow.

It is to be understood that the crossbow of the invention can be assembled by combining any suitable conventional bow and any suitable conventional trigger mechanism with the tiller of the invention; or by combining any suitable conventional tiller and any suitable conventional trigger mechanism with the bow of the invention; or by combining any suitable conventional trigger mechanism with the tiller of the invention and the bow of the invention.

In preferred embodiments of the invention the crossbow of the invention having the bow of the invention has preferred features defined above in relation to said bow.

Preferred trigger mechanism for the crossbow of invention has a case containing a nut in the form of a cylinder with a cut-out for the bowstring and an indentation located oppositely to said cut-out and accommodating a first ball from a set of at least two locking balls positioned one on the top of the other in the case, wherein the nut is connected with an stopper which abuts a spring-loaded retainer for said stopper, and the set of locking balls includes a working ball which on its one side is co-axially adjacent to a pusher connected with a trigger, and on its opposite side is adjacent to a working element of a counterrecoil mechanism, said working element being loaded with a recoil spring.

Preferably the trigger mechanism has the working element in the form of a ball.

Such a trigger mechanism is sturdy but simultaneously it has a high sensitivity, and thus requires a minimal force to release the bowstring for shooting a projectile. It provides also a high safety, as the trigger mechanism is easily protected against self-release by blocking the working element (ball) of a counterrecoil mechanism.

The crossbow of the invention can be used for any purpose, as a hunting crossbow, for sports competitions, to put animals to sleep, as a weapon etc. It can be adapted for any projectiles, e.g. arrows, bolts, harpoons and narcotising projectiles.

The tiller of the invention provides a cocking mechanism in the scissors-like form which allows to cock the crossbow by applying a minimal force to the end of the lower arm of the cocking lever.

Due to the modular construction of the bow it can be readily mounted on or removed from the tiller, which enables fast assembling and dismantling of the crossbow. This makes it very convenient for handling and transporting. Furthermore the structure of the bow results in the substantial reduction of the kick effect and diminishes the impact of inertial force on the person shooting the crossbow.

Furthermore the bow of the invention has a distinct advantage in that it can be up to 50% narrower than various conventional bows, and yet it still ensures exceptionally good cocking parameters. The structure of the bow, and in particular its pivotal connection about the bolts, provides for considerable reduction of friction between the bowstring and the projectile guide when the bowstring is drawn.

The structure of the modular parts of the crossbow, i.e. of the tiller and the bow, makes it possible to assembly a compact crossbow of a small width, easy to cock with a minimal effort, yet providing a large draw force. The crossbow is fast-firing and allows for discharging projectiles with a high initial velocity.

BRIEF DESCRIPTION OF THE DRAWINGS

Additional objects and advantages of the invention will become apparent to those skilled in the art upon reference to the detailed description of the invention in connection with the accompanying drawing wherein.

DESCRIPTION OF THE PREFERRED EMBODIMENTS

Figure 1:
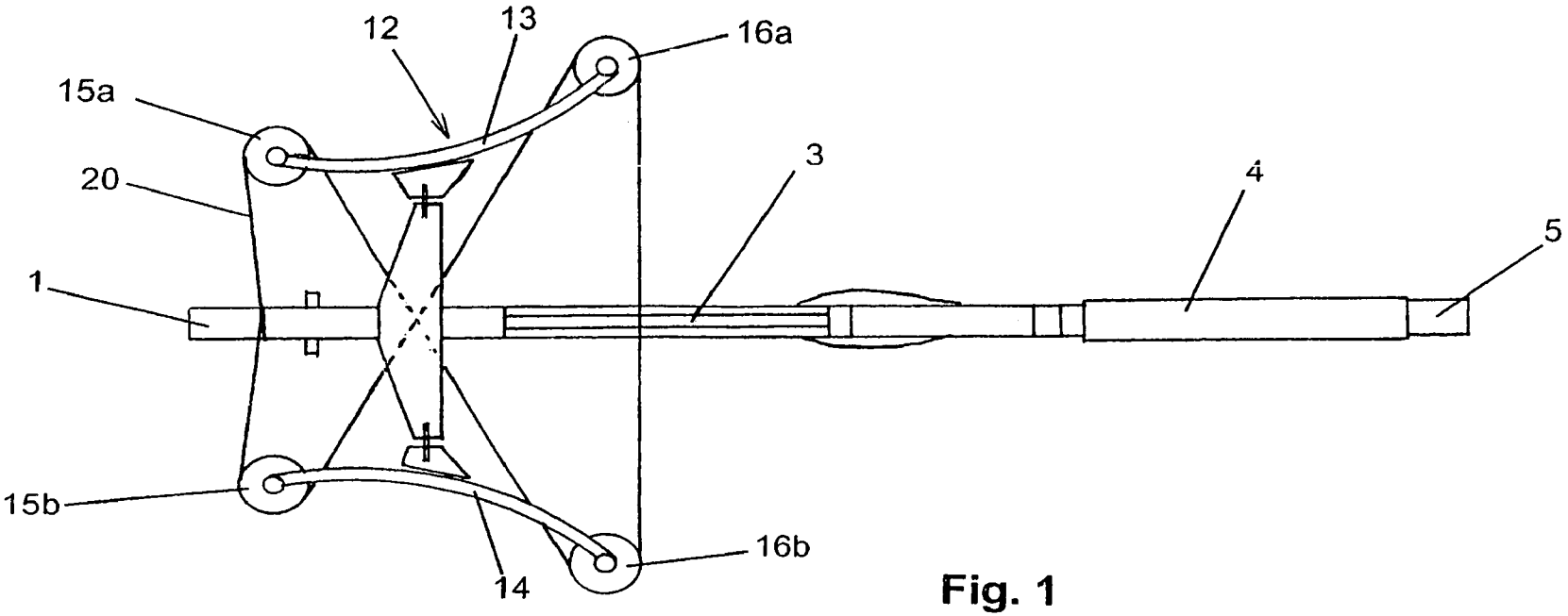
FIG. 1 is a top view of a crossbow of the invention having a tiller and bow of the invention.

FIG. 1 shows a crossbow of the invention in its uncocked state with its tiller folded and snapped, as described below.

Figure 2:
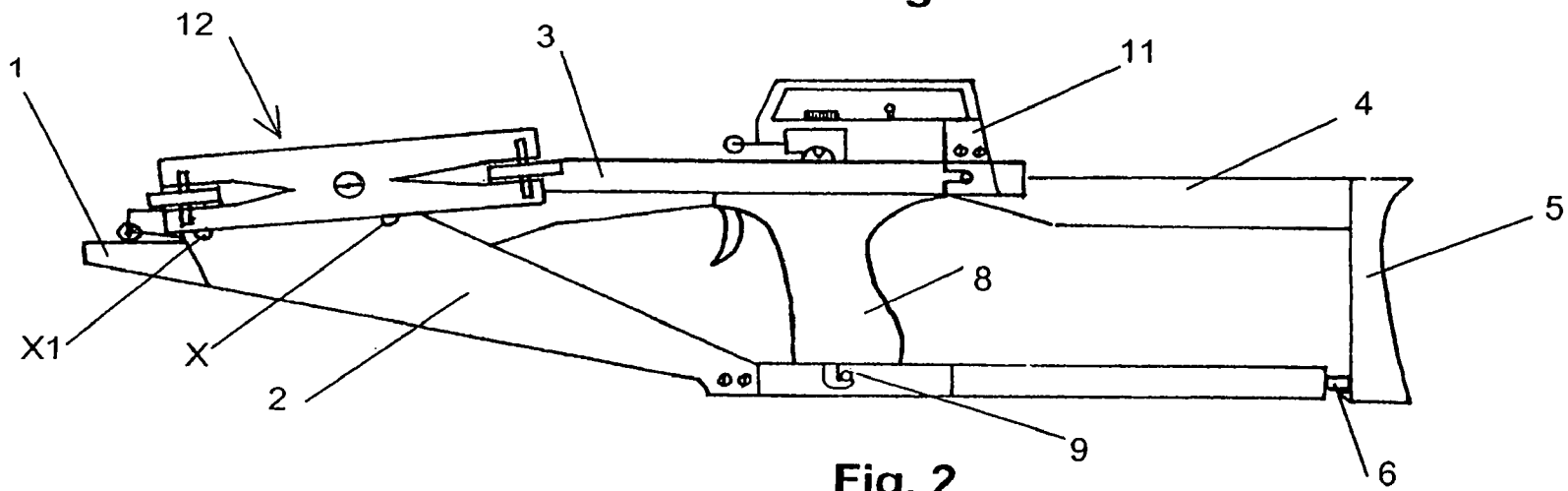
FIG. 2 is a side view of a crossbow of the invention having a tiller and bow of the invention.
Figure 3:
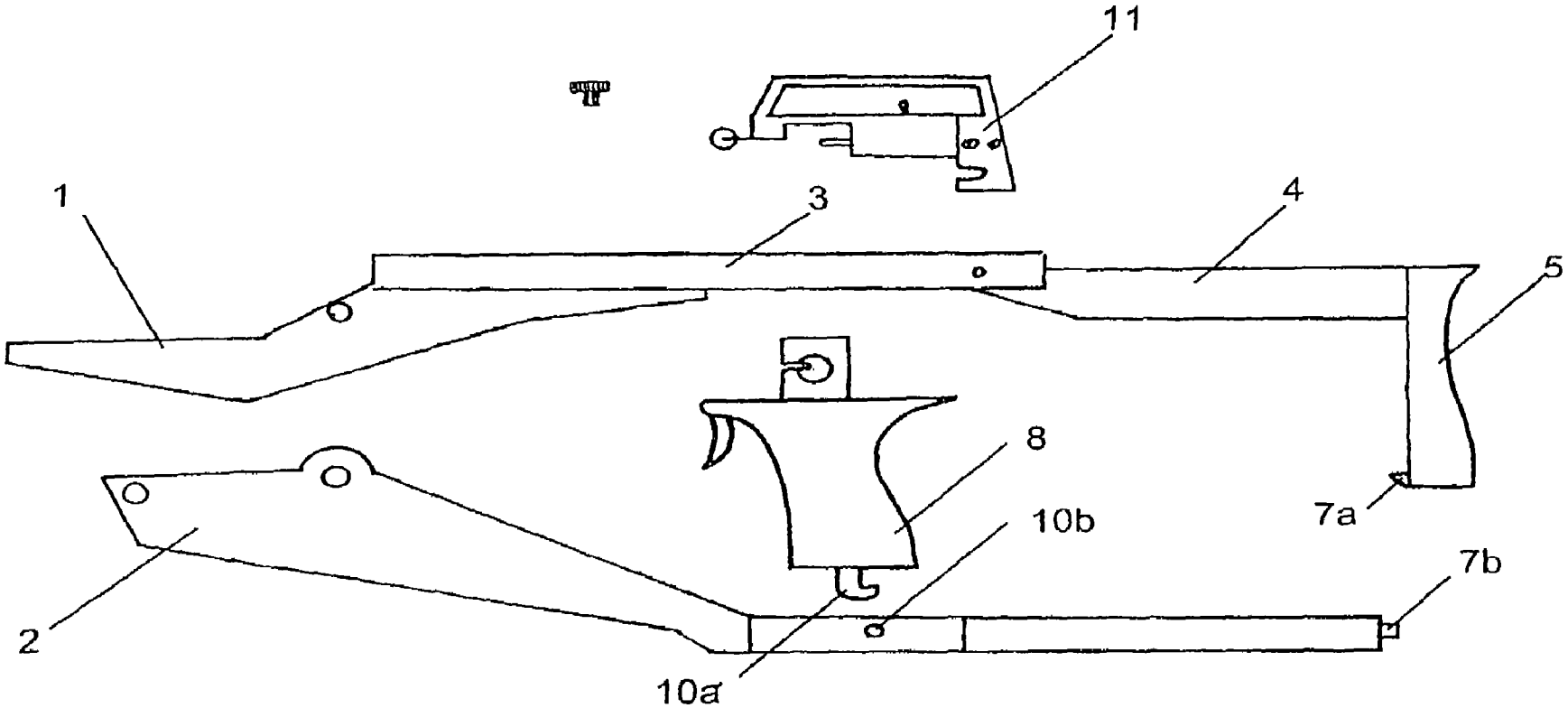
FIG. 3 is a side view of a disassembled tiller of the invention provided with a trigger portion and aiming device.
Figure 4:
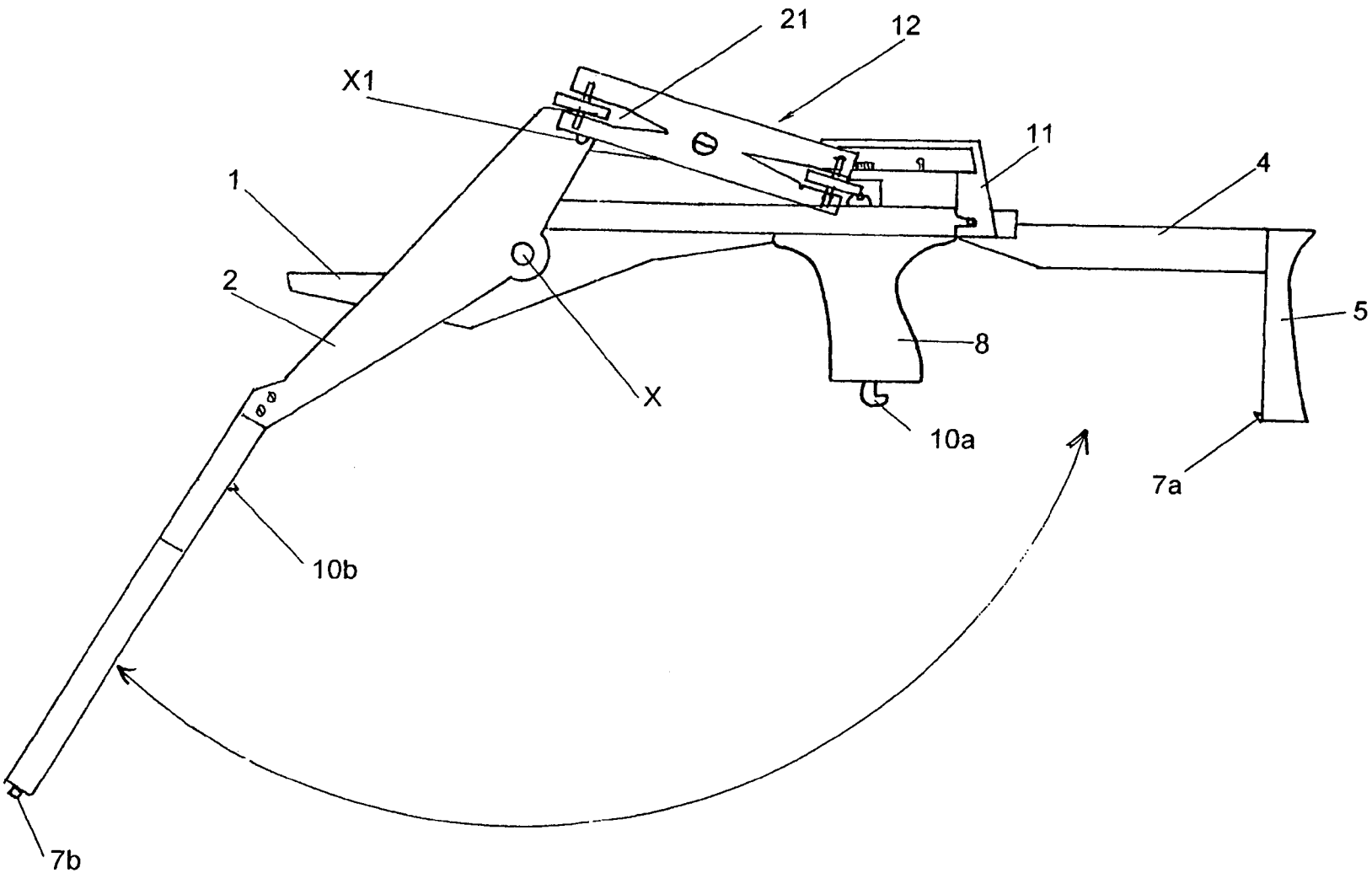
FIG. 4 is a side view of a crossbow of the invention with its tiller open and ready for drawing a bowstring.

FIGS. 2, 3 and 4 show the crossbow of FIG. 1, folded, disassembled (only the tiller, aiming device and trigger portion are shown) and unfolded respectively.

The tiller on which the bow (12) is mounted has a cocking lever in the form of two arms, an upper arm 1 and a lower arm 2, which are pivotably connected about an axis X in the front part of the tiller.

The upper arm 1 has a projectile guide 3 which abuts a butt bracket 4 through which the upper arm 1 is connected with the butt 5 in the rear part of the tiller.

The upper arm 1 is connected with the upper end of a butt 5, and said lower arm 2 is connected in the folded state of the tiller with the lower end of the butt 5 by means of a rear snap fastener 6. The rear snap fastener 6 is formed by a finger 7*a* on the butt 5 and a hook 7*b* at the end of the lower arm 2.

A trigger mechanism 8, described with details further below, is situated between the arms 1 and 2. In the folded state of a tiller the trigger mechanism 8 is connected with the lower arm 2 by means of a front snap fastener 9. The front snap fastener 9 consists of a finger 10*a* situated on the trigger mechanism 8, in its bottom part, and a hook 10*b* located on the lower arm 2 of the cocking lever.

In the region of the projectile guide 3 a conventional aiming mechanism 11 is mounted.

Figure 5:
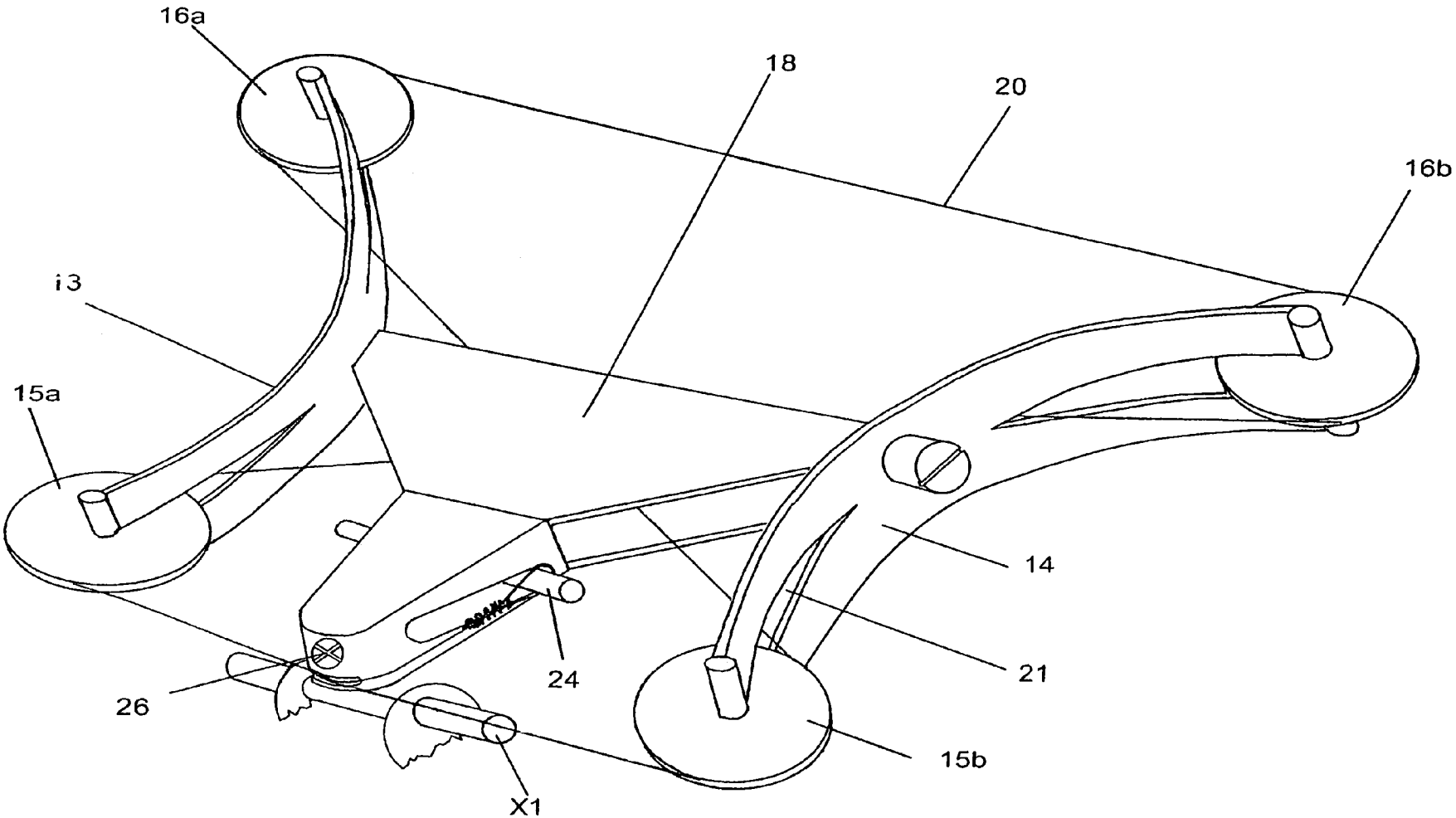
FIG. 5 is a perspective view of a bow of the invention.
Figure 6:
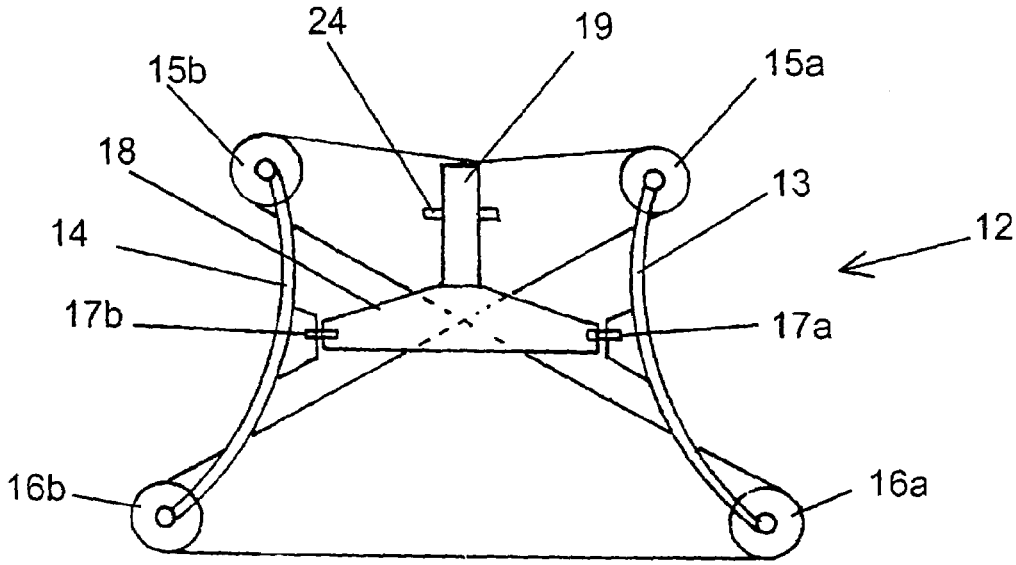
FIG. 6 is a top view of a bow of the invention in its uncocked state.
Figure 7:
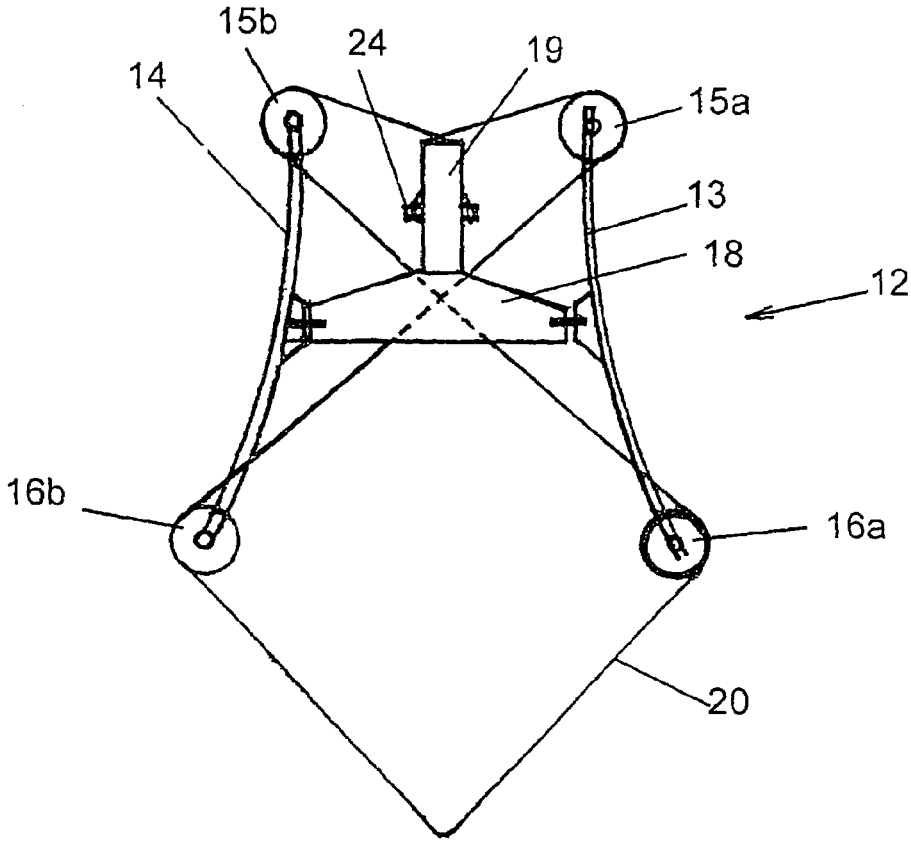
FIG. 7 is a top view of a bow of the invention in its cocked state.
Figure 10:
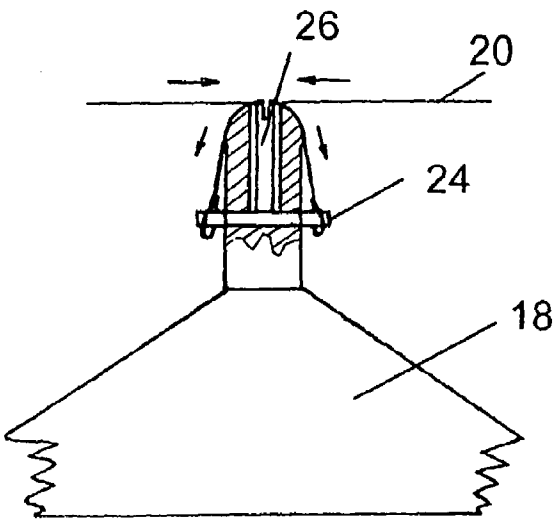
FIG. 10 is a top view with a part section of a pre-cocking mechanism in a bow with a drawn bowstring.
Figure 11:
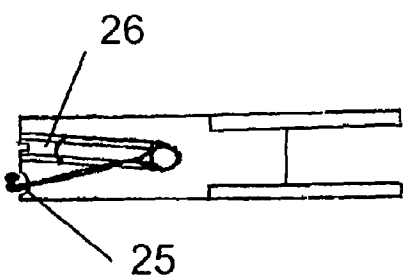
FIG. 11 is a side view of the pre-cocking mechanism of FIG. 10.
Figure 8:
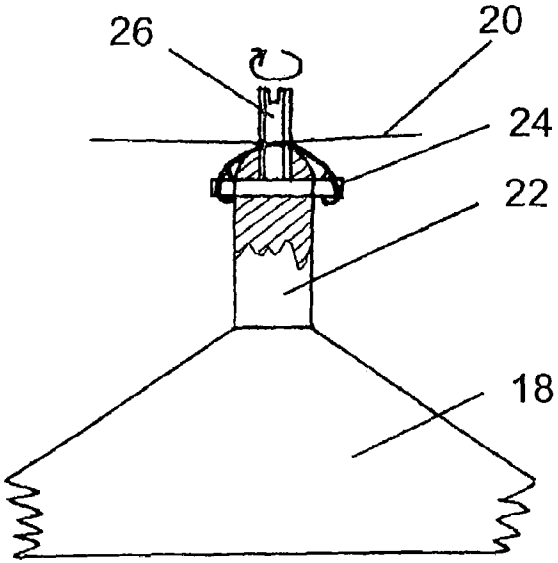
FIG. 8 is a top view with a part section of a pre-cocking mechanism in a bow with a non-drawn bowstring.
Figure 9:
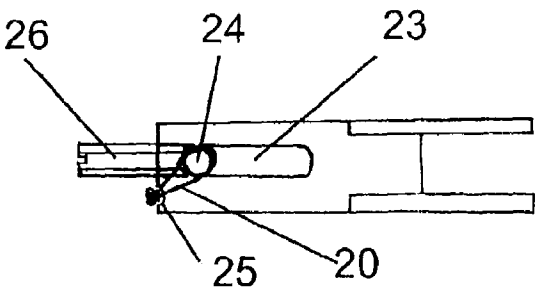
FIG. 9 is a side view of the pre-cocking mechanism of FIG. 8.

FIGS. 5, 6 and 7 show the bow 12 of the invention which can be mounted on a conventional tiller or on the tiller of the invention. The bow 12 is pivotably connected about an axis X1 with the lower arm 2 of the cocking lever, said axis X1 being positioned at a certain distance from the axis X. The bow 12 has two limbs 13, 14, both provided on their respective ends with front pulleys 15*a*, 15*b* and back pulleys 16*a*, 16*b*. The limbs 13, 14 are pivotally connected by means of bolts 17*a*, 17*b* with a central cross-bar 18 which carries a pre-cocking mechanism 19 to which a bowstring 20 is fastened. The limbs 13, 14 can be positioned parallel to the shot axis, but their rotatable attachment to the central cross-bar 18 allows to deflect them in relation to the plane of shot determined by the tiller and the central cross-bar 18, at a small angle to the shot axis. Such a deflection is advantageous since it reduces friction of the bowstring 20 against the projectile guide 3. The bow 12 can be fixed to the tiller with the use of any suitable locking means, e.g. a bayonet lock (not shown).

The bowstring 20 is fastened to a pre-cocking mechanism 19 and guided by the pulleys 15*a*, 15*b*, 16*a*, 16*b*. The first end of the bowstring 20 is fastened to the pre-cocking mechanism 19 on its side facing the second limb 14. From this point of fixation the bowstring 20 runs to the front pulley 15*a* of the first limb 13 and then, along the diagonal of the bow 12 to the back pulley 16*b* of the second limb 14, and then to the back pulley 16*a* of the first limb 13 from where it runs, along the diagonal of the bow 12, to the front pulley 15*b* of the second limb 14 and then to the place at which its second end is fastened, said place being situated on the pre-cocking mechanism 19 on its side facing the first limb 13.

In a preferred embodiment the limbs 13, 14 of the bow 12 are provided with recesses 21, advantageously of substantially triangular shape with vertices directed to the middle of the limbs. The pulleys 15*a*, 15*b*, 16*a*, 16*b* are mounted on their axles in the recesses 21 and the bowstring 20 passes through said recesses.

The bow 12 is provided with a pre-cocking mechanism, in a preferred embodiment designed as shown in FIG. 8–11.

The pre-cocking mechanism 19 is positioned centrally between the limbs 13, 14. It has a body 22 with a longitudinal slotted guide 23 for a draw pin 24. The guide 23 passes through said body 22 and has its respective outlets facing the limbs 13, 14. The ends of the bowstring 20 are fastened on the sides of the body 22 to the ends of the draw pin 24. From these fixation sites the bowstring 20 runs to the front pulleys 15*a*, 16*a* of the limbs 13, 14 through a notch 25 on the top of the body 22 adjacent to a threaded hole for a draw screw 26 connected with the draw pin 24. In a preferred embodiment the slotted guide 23 and the threaded hole for the draw screw 26 are situated diagonally in relation to the longitudinal axis of the body 22.

Figure 13:
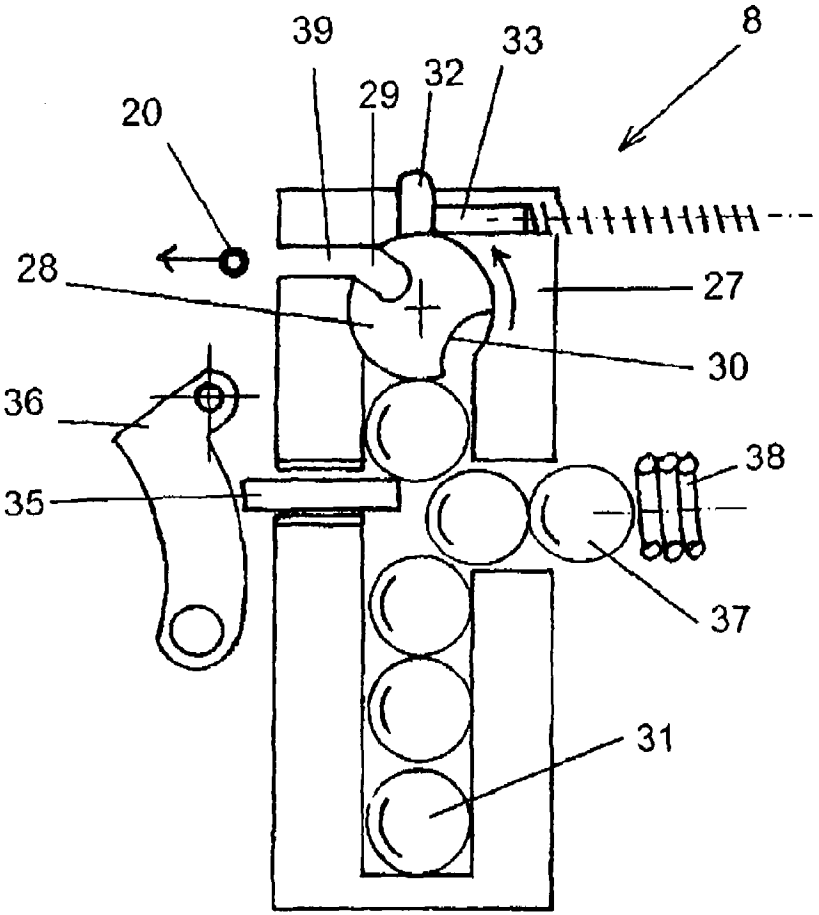
FIG. 13 is a schematic view of a trigger mechanism of FIG. 12 after the bowstring has been released.
Figure 12:
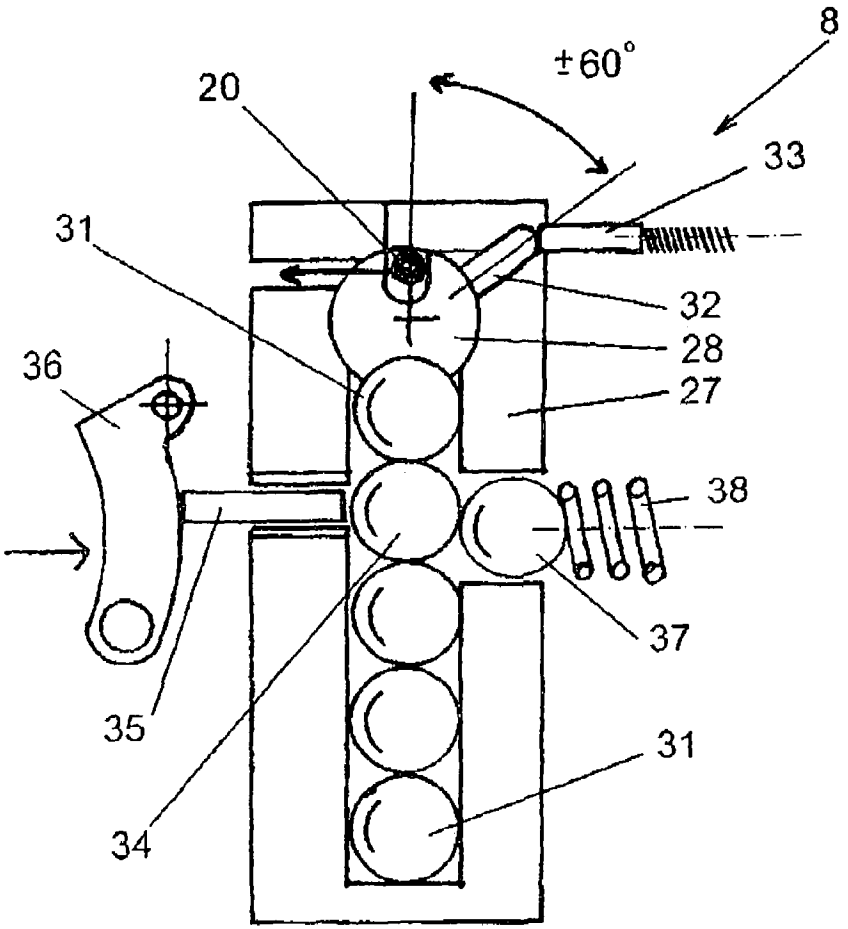
FIG. 12 is a schematic view of a preferred trigger mechanism to be used in the crossbow of the invention at its blocked position.

FIGS. 12 and 13 show a preferred trigger mechanism for the crossbow of the invention with the bowstring 20 arrested and released respectively.

The trigger mechanism 8 has a case 27 containing a nut 28 in the form of a cylinder with a cut-out 29 for the bowstring 20, and an indentation 30 located oppositely to said cut-out 29 and accommodating a first ball 31 from a set of at least two locking balls 31 positioned one on the top of the other in the case 27. The indentation 30 is shown as spherical, yet it can have a form of any cut-out able to accommodate the first ball 31. The nut 28 is connected with an stopper 32 which forces the return of the nut 28 to its pre-shot position in which the bowstring 20 can be introduced into the nut 28 through the slot 39 in the case 27 of the trigger mechanism. The stopper 32 abuts a spring-loaded retainer 33 of the stopper 32.

The set of locking balls 31 includes a working ball 34 which on its one side is co-axially adjacent to a pusher 35 connected with a trigger 36, and on its opposite side is adjacent to a working element 37 of a counterrecoil mechanism, said working element 37 being loaded with a recoil spring 38. In the shown embodiment the working element 37 is a ball.

The mode of operation of the above-described crossbow is as follows.

The bow 12 with the bowstring 20 pre-drawn by means of the pre-cocking mechanism 19 is mounted on the tiller. To shot the crossbow the bowstring 20 must be fully drawn. For this purpose the rear snap fastener 6 and the front snap fastener 9 are opened and the lower arm 2 is turned in relation to the upper arm 1 about the axis X, which simultaneously causes certain pivotal movement about the axis X1 and shifts the bow 12 towards the trigger mechanism 8. This combined displacement of the bow 12 shifts the bowstring 20 along the projectile guide 3 towards the trigger mechanism 8 and introduces the bowstring 20 through the slot 39 in the case 27 into the cut-out 29 in the nut 28. The action of the bowstring 20 on the surface of the cut-out 29 turns the nut 28 to the right, and the verge of the indentation 30 moves towards the top of the nearest locking ball 31 in the set of locking balls. As soon as said verge passed the top of said nearest locking ball 31, the ball slips into said indentation under the pressure of the element 37 loaded with the spring 38, and this action causes further rotation of the nut 28 which arrests the bowstring 20 within the cut-out 29. As shown in FIG. 12, at this moment the bowstring 20 is accommodated in the cut-out 29 which is positioned at the top of the nut 28 and the stopper 32 on the nut 28 is deflected at the angle of about 60° from the vertical axis of the case 27.

A final draw to the bowstring 20 is applied by folding the tiller, i.e. by turning the lower arm 2 of the cocking lever back till the front snap fastener 9 and the rear snap fastener 6 are both snapped. When a projectile is placed in the projectile guide 3, the crossbow is ready to be shot.

When the trigger 36 is pulled, the set of locking balls 31 becomes destabilized since the pusher 35 pushes out one of the balls 31 which acts as a working ball 34. The working ball 34 pushes the working element 37 of a counterrecoil mechanism which is loaded with the recoil spring 38. The draw force of the bowstring 20 turns the nut 28 by about 60° to the left till its rotation is stopped by the stopper 32. At this moment the cut-out 29 is aligned with the slot 39 in the case 27 of the trigger mechanism 8, the bowstring 20 is released and the crossbow discharges the projectile. The stopper 32 is retained in its topmost position by the retainer 32 which is loaded with a spring. This retaining system is shown as placed partially outside the case 27 but of course it is possible to have it fully integrated within the trigger mechanism in its case 27.

To shot the crossbow again, this simple cocking procedure is repeated.

The invention claimed is:

1. A tiller for a crossbow (12) characterized in that it has a cocking lever in the form of an upper arm (1) and a lower arm (2) pivotally connected with each other about a first axis (X) in the front part of the tiller, said first axis (X) is positioned at a certain distance from a second axis (X1) situated at an end of the lower arm (2) for mounting the crossbow bow (12), whereas in the rear part of the tiller said upper arm (1) is connected with the upper end of a butt (5), and said lower arm (2) is connected with the lower end of the butt (5) in the folded state of the tiller by means of a snap fastener (6).

2. The tiller of claim 1 wherein said crossbow (12) pivotably connects with the lower arm (2) about said second axis (X1).

3. A bow for a crossbow with pulleys for a bowstring, characterized in that it has two limbs (13, 14), the first limb (13) having on its respective ends a front pulley (15*a*) and a back pulley (16*a*), and a second limb (14) having on its respective ends a front pulley (15*b*) and a back pulley (16*b*), said limbs (13, 14) being pivotally connected by means of bolts (17*a*, 17*b*) with a central cross-bar (18) carrying a pre-cocking mechanism (19) to which a bowstring (20) is fastened, wherein the first end of the bowstring (20) is fastened to the pre-cocking mechanism (19) on its side facing the second limb (14), from where the bowstring (20) runs to the front pulley (15*a*) of the first limb (13) and then, along the diagonal of the bow (12), to the back pulley (16*b*) of the second limb (14), and then to the back pulley (16*a*) of the first limb (13) from where it runs, along the diagonal of the bow (12), to the front pulley (15*b*) of the second limb (14) and then to the place at which its second end is fastened, said place being situated on the pre-cocking mechanism (19) on its side facing the first limb (13).

4. A bow for a crossbow according to claim 3, characterized in that said limbs (13, 14) are provided at their both ends with recesses (21) in which the pulleys (15*a*, 15*b*, 16*a*, 16*b*) are fixed and through which the bowstring (20) runs.

5. A bow for a crossbow according to claim 4, characterized in that the recesses (32) are triangular with vertices directed towards the middle of the limbs (13, 14).

6. A bow for a crossbow according to claim 4, characterized in that the slotted guide (23) and the threaded hole for the draw screw (26) are situated diagonally in relation to the longitudinal axis of the body (22).

7. A bow for a crossbow according to claim 3, characterized in that the pre-cocking mechanism (19) is positioned centrally between the limbs (13, 14) and has a body (22) with a longitudinal slotted guide (23) for a draw pin (24), said guide (23) passing through said body (22) in the direction of the limbs (13, 14), and the ends of the bowstring (20) are fastened on the sides of the body (22) to the ends of the draw pin (24) from where the bowstring (20) runs to the front pulleys (15*a*, 16*a*) of the limbs (13, 14) through a notch (25) on the top of the body (22) adjacent to a threaded hole for a draw screw (26) connected with the draw pin (24).

8. A crossbow having a cocking mechanism and a bow with pulleys for a bowstring, said bow being mounted on a tiller including a projectile guide and provided with an aiming mechanism and a trigger mechanism, characterized in that the tiller of said crossbow has a cocking lever in the form of an upper arm (1) and a lower arm (2) pivotally connected with each other about an axis (X) in the front part of the tiller, whereas in the rear part of the tiller said upper arm (1) is connected with the upper end of a butt (5), and said lower arm (2) is connected with the lower end of the butt (5) in the folded state of the tiller by means of a snap fastener (6); the bow of said crossbow has two limbs (13, 14), the first limb (13) having on its respective ends a front pulley (15*a*) and a back pulley (16*a*), and a second limb (14) having on its respective ends a front pulley (15*b*) and a back pulley (16*b*), said limbs (13, 14) being pivotally connected by means of bolts (17*a*, 17*b*) with a central cross-bar (18) carrying a pre-cocking mechanism (19) to which a bowstring (20) is fastened, wherein the first end of the bowstring (20) is fastened to the pre-cocking mechanism (19) on its side facing the second limb (14), from where the bowstring (20) runs to the front pulley (15*a*) of the first limb (13) and then, along the diagonal of the bow (12), to the back pulley (16*b*) of the second limb (14), and then to the back pulley (16*a*) of the first limb (13) from where it runs, along the diagonal of the bow (12), to the front pulley (15*b*) of the second limb (14) and then to the place at which its second end is fastened, said place being situated on the pre-cocking mechanism (19) on its side facing the first limb (13).

9. A crossbow according to claim 8, characterized in that said limbs (13, 14) of the bow (12) are provided at their both ends with recesses (21) in which the pulleys (15*a*, 15*b*, 16*a*, 16*b*) are fixed and through which the bowstring (20) runs.

10. A crossbow according to claim 9, characterized in that the recesses (32) are triangular with vertices directed towards the middle of the limbs (13, 14).

11. A crossbow according to claim 8, characterized in that in the bow (12) the pre-cocking mechanism (19) is positioned centrally between the limbs (13, 14) and has a body (22) with a longitudinal slotted guide (23) for a draw pin (24), said guide (23) passing through said body (22) in the direction of the limbs (13, 14), and the ends of the bowstring (20) are fastened on the sides of the body (22) to the ends of the draw pin (24) from where the bowstring (20) runs to the front pulleys (15*a*, 16*a*) of the limbs (13, 14) through a notch (25) on the top of the body (22) adjacent to a threaded hole for a draw screw (26) connected with the draw pin (24).

* * * * *